US008157090B2

(12) United States Patent
Ingvardsen et al.

(10) Patent No.: US 8,157,090 B2
(45) Date of Patent: Apr. 17, 2012

(54) BALL TRAY ORGANIZER FOR SUBTERRANEAN COMPLEX COMPLETIONS

(75) Inventors: Donald F. Ingvardsen, Spring, TX (US); Rafael Ramirez, Houston, TX (US); David B. Ruddock, Pearland, TX (US); Michael J. Naquin, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 155 days.

(21) Appl. No.: 12/605,055

(22) Filed: Oct. 23, 2009

(65) Prior Publication Data

US 2011/0094901 A1 Apr. 28, 2011

(51) Int. Cl.
*B65D 85/00* (2006.01)

(52) U.S. Cl. ..... 206/315.9; 206/562; 206/563; 206/499; 211/14

(58) Field of Classification Search ..... 206/315.9, 206/315.91, 499, 443, 562, 563, 379, 419, 206/420, 421, 422, 372–377; 211/14, 60.1, 211/126.2, 69; 99/342
See application file for complete search history.

(56) References Cited

U.S. PATENT DOCUMENTS

| | | | | | |
|---|---|---|---|---|---|
| 1,371,272 | A | * | 3/1921 | Strong | 224/483 |
| 2,313,473 | A | * | 3/1943 | Woodrow et al. | 273/241 |
| 2,564,601 | A | * | 8/1951 | Huot | 206/379 |
| 3,161,156 | A | * | 12/1964 | Batista et al. | 249/120 |
| 4,214,684 | A | * | 7/1980 | Galowitz | 294/161 |
| 4,411,868 | A | * | 10/1983 | Noack | 422/562 |
| 4,850,484 | A | | 7/1989 | Denman | |
| 4,875,744 | A | | 10/1989 | Wettstein | |
| 5,040,681 | A | | 8/1991 | Grusin | |
| 5,116,264 | A | | 5/1992 | Wiederrich et al. | |
| D333,568 | S | | 3/1993 | Dickinson | |
| 5,305,935 | A | | 4/1994 | Weiner | |
| 5,320,223 | A | * | 6/1994 | Allen | 206/372 |
| 5,482,342 | A | | 1/1996 | Kowalski et al. | |
| 5,544,744 | A | | 8/1996 | Oman | |
| 5,587,877 | A | | 12/1996 | Ryan et al. | |
| 5,602,963 | A | | 2/1997 | Bissonette et al. | |
| 5,797,491 | A | | 8/1998 | Fierek et al. | |
| 5,823,363 | A | * | 10/1998 | Cassel | 211/60.1 |
| 5,826,719 | A | | 10/1998 | Chen et al. | |
| 6,450,330 | B1 | | 9/2002 | Cannata | |
| 6,530,524 | B1 | | 3/2003 | Kuroda et al. | |

(Continued)

OTHER PUBLICATIONS

Craftsman 6 pc. Socket Tray Organizer; http://www.sears.com/shc/s/ProductDisplay?partNumber=00965165000P&storeId=10153&catalogId=12605.

*Primary Examiner* — David Fidei
(74) *Attorney, Agent, or Firm* — Steve Rosenblatt

(57) ABSTRACT

An organization system for a series of objects to be sequentially run downhole is disclosed. The preferred objects are spheres of progressively larger diameter put into a wellbore to land at discrete locations for operation of ports in a given sequence so that a specific producing zone or zones can be completed in increments that preferably go in an uphole direction as progressively larger spheres are inserted. In the preferred embodiment the process is fracturing where a series of ported subs are operated to selectively open for the fracture procedure at a specific location and then close or become isolated when another sphere is dropped. Optionally the balls can be recovered at the surface when production starts. The organizer prevents size confusion and gives a ready feedback as to the progress of a given job. Trays can be stacked and carried in a carrying case.

17 Claims, 3 Drawing Sheets

U.S. PATENT DOCUMENTS 6,872,423 B2 * 3/2005 Brown et al. ..... 427/314
7,028,854 B1 4/2006 Londrico
7,306,107 B2 12/2007 Secondino
2001/0054570 A1 12/2001 Danko
2006/0260966 A1 * 11/2006 Lake et al. ..... 206/419
2009/0301914 A1 * 12/2009 Kahle ..... 206/419

* cited by examiner

BALL TRAY ORGANIZER FOR SUBTERRANEAN COMPLEX COMPLETIONS

FIELD OF THE INVENTION

The field of the invention is organizers for subterranean equipment that is used in a predetermined sequence and more particularly to organizers for numerous balls that have to be deployed in a particular sequence that are close in size to each other.

BACKGROUND OF THE INVENTION

Completions in subterranean wells have grown more complicated. Completions assemblies frequently involve sequential operations for fracturing segments of a zone in a sequence or a plurality of zones in a predetermined order. To do this requires sequential operation of access valves that are commonly pressure actuated by landing of a ball on a seat and pressuring up to shift a sleeve to align or misalign ports for formation access. In some cases more than a single ball is used to move a specific valve during the staged fracturing procedure.

The balls that are used to sequentially operate the valves are very close in size. Many times in the field there can be time gaps between operations so that personnel make shift change during those pauses. Opportunities exist for confusing which ball was last deployed. Many of the balls are very close in size because of the need to run so many of them with an upper limit on how big the largest ball can be because of the size of the tubular string and a lower limit to how small the smallest ball can be and still function as a barrier to allow pressure differential to operate a downhole device. As a result an organization system is needed to allow an array of balls to be organized before a job starts and then during a job the organizer helps to keep track of the last deployed ball so that there is no doubt as to which ball is to be deployed next. Since these decisions are made at a well site, a handy carrying case can be associated with organizing ball trays. To take up less space in a truck going to a job the trays can be stacked in a carrying case.

The following patents relate to parts organizers in general: U.S. Pat. Nos. 7,306,107; 7,028,854; 6,530,524; 5,797,491; 5,602,963; 5,587,877; 5,544,744; 5,482,342; 5,305,935; D333,568; U.S. Pat. Nos. 5,116,264; 5,040,681 and 4,875,744. Sears sells a socket organizer for tool boxes that has a tray with labeled holes where the sockets are inserted to be guided by the tray and supported by the bottom of the tool cabinet drawer as illustrated in its catalog having the following link: http://www.sears.com/shc/s/ProductDisplay?partNumber=00965165000P&storeId=10153&catalogId=12605

Those skilled in the art will be better able to understand the scope of the invention from a review of the description of the preferred embodiment and the associated drawings while understanding that the full scope of the invention is given by the appended claims.

SUMMARY OF THE INVENTION

An organization system for a series of objects to be sequentially run downhole is disclosed. The preferred objects are spheres of progressively larger diameter put into a wellbore to land at discrete locations for operation of ports in a given sequence so that a specific producing zone or zones can be completed in increments that preferably go in an uphole direction as progressively larger spheres are inserted. In the preferred embodiment the process is fracturing where a series of ported subs are operated to selectively open for the fracture procedure at a specific location and then close or become isolated when another sphere is dropped. Optionally the balls can be recovered at the surface when production starts. The organizer prevents size confusion and gives a ready feedback as to the progress of a given job. Trays can be stacked and carried in a carrying case.

DETAILED DESCRIPTION OF THE PREFERRED EMBODIMENT

Downhole operations have grown more complex and frequently require objects to be sequentially introduced at spaced apart intervals that can take days and involve different personnel sometimes working in less than ideal weather conditions. When the objects are very close in size and the job length takes days, there are opportunities for mistakes. One type of downhole operation that requires multiple balls of different sizes to be introduced at different times is sequential fracturing. There is a plurality of ball seats in the well that the balls need to land on in sequence so that different zones or portions of zones can be fractured in sequence, generally from a bottom to top direction. Some of the ball seats are equipped to handle two balls of the same size depending on their functionality.

Normally an array of balls is picked at a field office and bundled for a specific job. While the balls themselves can be given sequence numbers printed on the ball face as a way to maintain the proper ball size sequence, there are risks in making this the exclusive method for keeping track of which ball is next at the job site. The field crew still has to keep a separate record of which balls have already been dropped. The field crew has to pick through a bag of balls for the one marked with the smallest dimension. There are also risks of numbers being read wrong for example as between balls marked with "6" and "9" even if an underlining system is used to visually suggest the proper orientation for reading a number off of a ball. Some jobs take place in poor weather conditions such as dim light or fog or other weather extremes that can affect human perception of numbers on balls. Some jobs drag on for days and involve crew changes while others can be far shorter in duration and be completed in a single day. These considerations of human fatigue and possible garbled communication give rise to the concept of an organizer of the present invention that seeks to not only keep multiple balls arranged in a orderly fashion but also allows the balls to be properly sized with a physical feedback and a visual clue to which ball is next on a particular sequence at a job site. A carrying case and stackability are added features so that the arrays do not take up too much space in a truck going out to a job.

In some instances, two balls of the same dimension are needed to be deployed on a single seat assembly. The present invention can also group balls that are deployed in close proximity to further enhance the accuracy of the ball dropping sequence.

Figure 1:
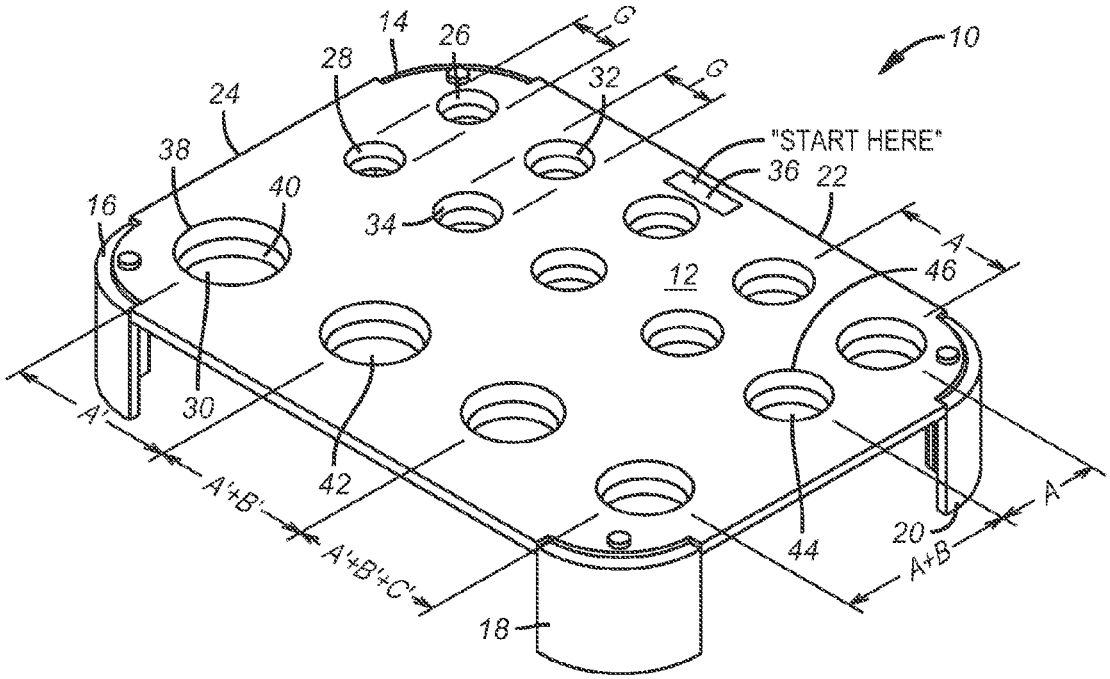
FIG. 1 is a perspective view of one rack for the smallest balls on a job that are used first.
Figure 4:
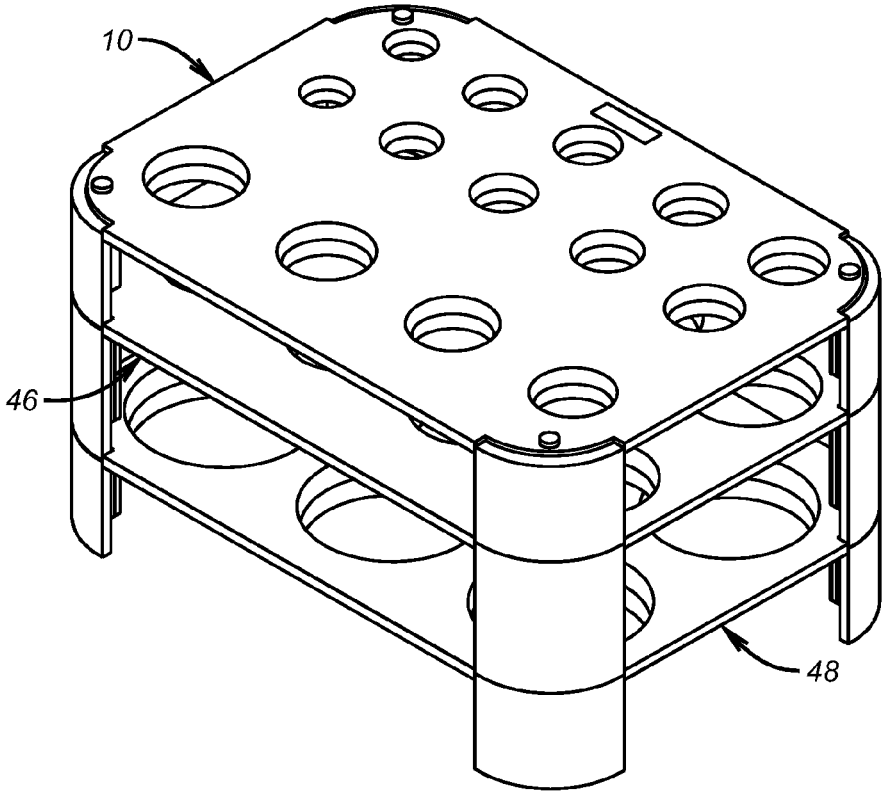
FIG. 4 is a perspective view of the racks of FIGS. 1-3 vertically stacked for transport in a compact carrying case that is shown in FIG. 5.

Referring to FIG. 1 a tray assembly 10 has a flat top 12 and legs 14, 16, 18 and 20 so as to lift the top 12 from an available work surface (not shown) or another top that holds other balls as shown in the stacked arrangement in FIG. 4. The top 12 has a long dimension 22 and a width 24. A square configuration is possible as an alternative configuration. Openings 26 and 28 are closer to each other than the distance between opening 28 and opening 30. Thus the first two rows parallel to edge 22 by their proximity reveal that for a particular seat downhole (not shown) that a pair of balls placed in openings 26 and 28 for example are deployed sequentially and are preferably also the same size. The next balls to be deployed would be in positions 32 and 34 and so on going from left to right in FIG. 1 before the bottom row with opening 30 is deployed again going from left to right in FIG. 1 starting at ball 30.

The preferred orientation is that in a given row the balls 13 get bigger from left to right and in a given platform 12 the balls get bigger going down along the dimension 24. Since so many balls are deployed they are also close in size so that size differences between adjacent openings are difficult to see in the FIGS. The tray 12 and its counterparts that will be later described can also contain a visual clue as to the proper orientation to starting a ball sequence. The rectangle 36 is a schematic representation of such a clue. It can be a label with instructions to "start here" that can also include an arrow pointing to the first ball to be picked off the tray 12. Generally, the first ball off any tray such as 12 should be picked from the upper left hand corner of that tray. As an alternative if the tray 12 is made of plastic a "start here" arrow can be incorporated into the mold so that it unmistakably appears pointing to the starting ball. Optionally such an arrow can be in a contrasting color to call greater attention to the proper orientation so that the right first ball is selected from each tray. Another option is to indicate the diameter of each ball into the plastic tray 12 top right beside each associated opening in the tray 12 when the tray 12 is injection molded.

Each hole, for example hole 30 is structured to replicate the ball seat downhole onto which the ball in question will land when it is deployed. Thus for example hole 30 has an inlet 38 that preferably is slightly larger than the diameter of the ball intended to land in hole 30 to give a coarse feedback that the ball delivered to opening 30 is the right size. The seat 40 is preferably a reconstruction of the tapered seat that is also located downhole for the ball in question. Thus a properly sized ball advanced toward opening 30 narrowly clear diameter 38 and be stopped by the simulated seat 40 and retained to the tray 12 in case the tray is tipped for any reason. That same ball if presented at hole 42 would go right through hole 42 and if presented in hole 44 would not enter the larger diameter 46 up to its centerline. In that manner, presenting a ball at the wrong hole will give a visual and a tactile clue that something is amiss. In general these concepts apply to any ball presented at the wrong hole while a ball presented at the right hole will go in easily and get seated on the seat associated with that hole. Note that the seat need not be a taper and could just be a smaller bore than the hole entrance. For example in hole 30 seat 40 can be a smaller cylindrical bore than bore 38.

Figure 2:
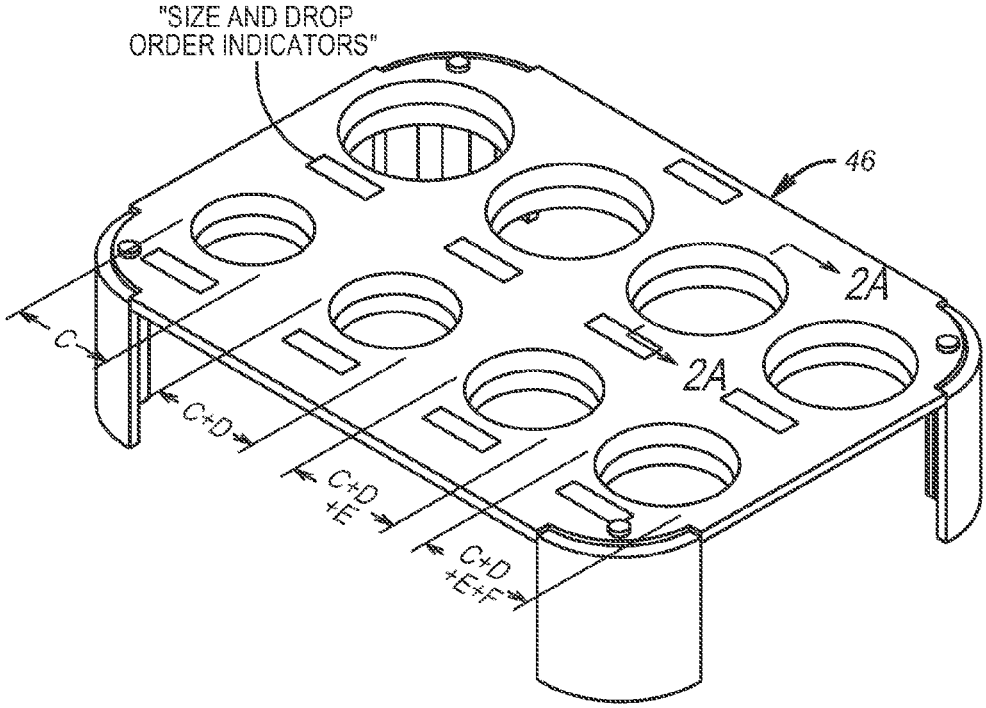
FIG. 2 is a perspective view of a second rack with bigger balls than the rack of FIG. 1.
Figure 2A:
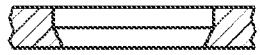
FIG. 2*a* is a view along section line 2*a*-2*a* in FIG. 2.
Figure 3:
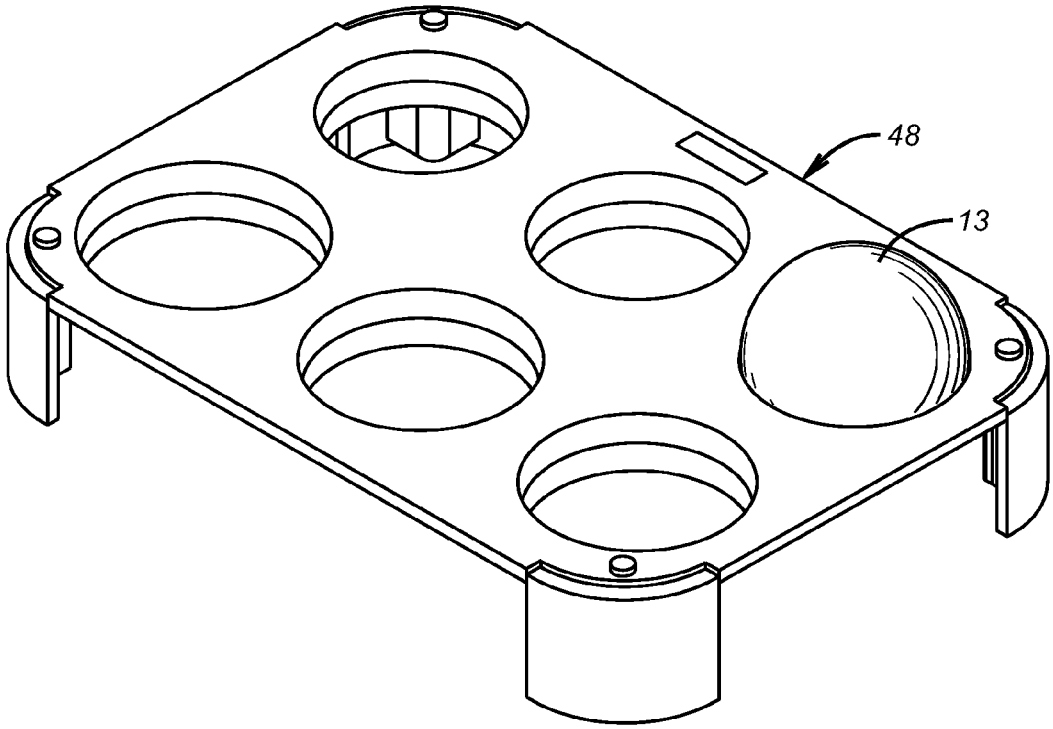
FIG. 3 is a perspective view of a third rack with the biggest balls for a given job.
Figure 5:
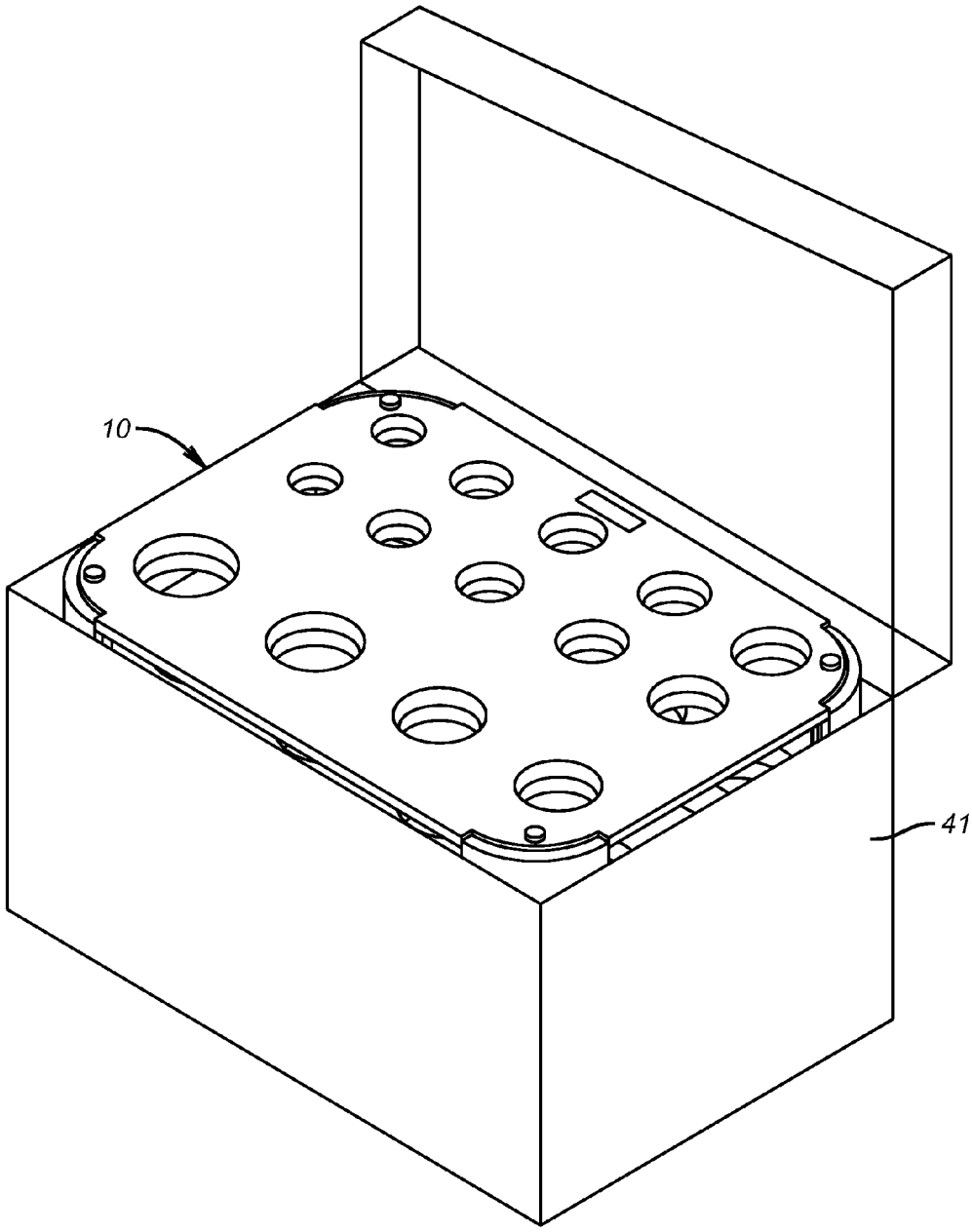
FIG. 5 is the view of FIG. 4 showing the stacked trays in a carrying case.

FIGS. 2 and 3 are similar to FIG. 1 except the openings are larger to accommodate progressively larger balls as the job goes on. The same concepts apply to those assemblies as was reported above in detail with respect to FIG. 1. FIG. 4 shows a stacked arrangement with tray 10 on top followed by trays 46 and then 48 on the bottom. When stacked on the respective legs after the balls are loaded, the whole assembly is compact and can fit into a smaller optional carrying case 41, shown in FIG. 5, to go in the truck or on the boat to a well site. Some smaller jobs can get by with fewer trays than shown in FIG. 4 while others may yet require more trays.

FIG. 1 shows the top two rows with a smaller spacing A between each other and between openings in a given row. The spacing between the middle row and the bottom row is bigger or A+B The spacing in the bottom row among openings is also variable going from left to right such as A', A'+B' and A'+B' +C'. The above arrangement gives visual clues that the balls in the two top rows are the same size since they are in a narrower spacing between rows and of an equal spacing in each row. The bottom row is spaced further away than the spacing between the top two rows to indicate that the balls in that row are of different sizes as further accentuated by the increasing spacing along the bottom row shown graphically with ever larger centerline spacing distances, i.e. C, D+D, C+D+E and C+D+E+F. The rectangles adjacent the openings shown for example in FIG. 2 are locations where information can be provided as to the ball size that goes there and the drop order if the size difference as written there is not already a sufficient clue as to the appropriate order to drop the objects.

The above description is illustrative of the preferred embodiment and many modifications may be made by those skilled in the art without departing from the invention whose scope is to be determined from the literal and equivalent scope of the claims below:

We claim:

1. An organizer for objects to be delivered to a subterranean location in a predetermined order, comprising:

a plurality of different spherical objects having a plurality of diameters about a center thereof said objects when delivered to a subterranean location are capable of isolating one part of a borehole from another and withstanding applied pressure for operation of a downhole tool;

a plurality of trays stackable one above another, said trays having a plurality of circular openings that have different diameters, each said opening on said trays having a seat along a periphery of each said opening, so that a given spherical object will enter said seat of a given opening for support thereof to the center of said given spherical object indicating a fit of said given spherical object to said seat of a given opening, said given spherical object passing through a seat of an opening having a diameter larger than said given spherical object, and said given spherical object failing to enter a seat of an opening having a diameter smaller than said given spherical object;

said spherical objects when placed in respective seats for a fit on said plurality of trays determine the order of removal of said objects from said trays for deployment in the wellbore;

a rigid carrying case for said trays said case suitable for transit with other downhole equipment to a well location for deployment of said spherical objects to a subterranean location.

2. The organizer of claim 1, wherein:

said openings are arranged in rows on each said tray where the opening size increases in each row from left to right.

3. The organizer of claim 2, wherein:

said openings are arranged in parallel rows.

4. The organizer of claim 3, wherein:

spacing among parallel rows on each said tray measured in a direction perpendicular to centerlines of said rows is different.

5. The organizer of claim 4, wherein:

openings in parallel rows that are closer together on a given said tray have identical opening sizes which identical opening sizes are a different size than identical openings in parallel rows that are closer together on another said tray.

6. The organizer of claim 3, wherein:

said openings have at least two dimensions.

7. The organizer of claim 6, wherein:

said openings have an inlet dimension above a seat dimension.

8. The organizer of claim 7, wherein:

said inlet dimension is larger than said seat dimension;

said seat comprises a taper or a cylindrical bore.

9. The organizer of claim 8, wherein:

a properly sized spherical object will clear said inlet dimension and be supported on said seat dimension.

10. The organizer of claim 8, wherein:

an improperly sized spherical object will either clear both inlet and seat dimensions if it is too small or will fail to enter said inlet dimension up to a centerline of the sphere.

11. The organizer of claim 10, wherein:

said tray has an indicator thereon for proper orientation for sequential removal of said spheres.

12. The organizer of claim 1, wherein:

said openings get larger from top to bottom of said stackable trays.

13. The organizer of claim 1, wherein:

said openings are arranged in parallel rows with equal or unequal spacing.

14. The organizer of claim 1, wherein:

openings on a lower of a vertical stack of trays are larger on said lower tray than openings on an upper said tray of said vertical stack.

15. The organizer of claim 14, further comprising:

a carrying case for said trays.

16. The organizer of claim 9, wherein:

said properly sized spherical object will be retained to said seat dimension if said tray is tipped over.

17. The organizer of claim 1, wherein:

said properly sized spherical object will be retained to said seat dimension if said tray is tipped over.

* * * * *